US006943641B2

(12) United States Patent
Shimizu

(10) Patent No.: US 6,943,641 B2
(45) Date of Patent: Sep. 13, 2005

(54) SMALL NON-RECIPROCAL CIRCUIT ELEMENT WITH GOOD PRODUCTIVITY

(75) Inventor: Yuichi Shimizu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 92 days.

(21) Appl. No.: 10/689,451

(22) Filed: Oct. 20, 2003

(65) Prior Publication Data

US 2004/0080375 A1 Apr. 29, 2004

(30) Foreign Application Priority Data

Oct. 22, 2002 (JP) ..... 2002-306429

(51) Int. Cl.[7] ..... H01P 1/383
(52) U.S. Cl. ..... 333/1.1; 333/24.2
(58) Field of Search ..... 333/1.1, 24.2

(56) References Cited

U.S. PATENT DOCUMENTS 3,467,918 A * 9/1969 Dunn et al. ..... 333/1.1
2003/0006855 A1 * 1/2003 Yoneda ..... 333/1.1

FOREIGN PATENT DOCUMENTS

JP 2000-332510 11/2000

* cited by examiner

*Primary Examiner*—Stephen E. Jones
(74) *Attorney, Agent, or Firm*—Brinks Hofer Gilson & Lione

(57) ABSTRACT

A non-reciprocal circuit element includes first, second, and third central conductors, which are formed of thin films or thick films. Each of the first, second, and third central conductors includes a first extended portion which extends from one end of the corresponding central conductor and which is disposed on a side surface of the ferrite part and a second extended portion which extends from the other end of the corresponding central conductor and which is disposed on the side surface of the ferrite part. The adjacent first and second extended portions face each other with a second dielectric part formed of a thin film or a thick film disposed therebetween, and hence a capacitor is formed between the adjacent first and second extended portions. Without using known chip capacitors, the capacitors are thinly formed, leading to reduction in cost and size of the non-reciprocal circuit element.

10 Claims, 8 Drawing Sheets

SMALL NON-RECIPROCAL CIRCUIT ELEMENT WITH GOOD PRODUCTIVITY

This application claims the benefit of priority to Japanese Patent Application 2002-306429, filed on Oct. 22, 2002.

BACKGROUND OF THE INVENTION

1. Field of the Invention

The present invention relates to non-reciprocal circuit elements, such as circulators and isolators, to be applied to transmitting and receiving systems or the like.

2. Description of the Related Art

FIGS. 13 and 14 show a known non-reciprocal circuit element. Specifically, FIG. 13 is an exploded perspective view of the known non-reciprocal circuit element, and FIG. 14 is a perspective view of a ferrite part of the known non-reciprocal circuit element.

Referring to FIGS. 13 and 14, the structure of the known non-reciprocal circuit element will now be described. A base 51, which is a synthetic-resin molded part, includes a recess 51*a* disposed at the center and a plurality of notches 51*b* disposed on the top surface of the base 51.

Three chip capacitors C1, C2, and C3 and a chip resistor R are housed in the notches 51*b*.

First, second, and third central conductors 53, 54, and 55 formed of thin films are disposed on the top surface of a disc-shaped ferrite part 52.

The first, second, and third central conductors 53, 54, and 55 are stacked on one another with dielectric parts (which are not shown in these figures) formed of insulating thin films disposed therebetween. Portions of the first, second, and third central conductors 53, 54, and 55 intersect at an angle of 120°.

The ferrite part 52 is housed in the recess 51*a*. One end of the first central conductor 53 is wire-bonded to the capacitor C1. One end of the second central conductor 54 is wire-bonded to the capacitor C2. One end of the third central conductor 55 is wire-bonded to the capacitor C3.

Two magnetic discs 56 are disposed above and below the ferrite part 52. On the top surface of the upper magnetic disc 56, a first yoke 57 is disposed. On the bottom surface of the lower magnetic disc 56, a second yoke 58 is disposed. The first and second yokes 57 and 58 are connected to form a magnetic closed circuit.

The above mentioned known non-reciprocal circuit element has the first, second, and third thin-film central conductors 53, 54, and 55 disposed only on the top surface of the ferrite part 52. To arrange the first, second, and third central conductors 53, 54, and 55 on the ferrite part 52, wires must be used. This is unfavorable in terms of productivity and cost.

Since the above mentioned known non-reciprocal circuit element requires the chip capacitors C1, C2, and C3 and the chip resistor R, it is cumbersome to assemble these parts in place. The size of the non-reciprocal circuit element becomes large.

SUMMARY OF THE INVENTION

Accordingly, it is an object of the present invention to provide a small inexpensive non-reciprocal circuit element with good productivity.

To achieve the above mentioned object, according to an aspect of the present invention, a non-reciprocal circuit element is provided including a flat plate-shaped ferrite part; and first, second, and third central conductors disposed over a plurality of surfaces of the ferrite part, wherein the first, second, and third central conductors on a top surface of the ferrite part are stacked on one another with first dielectric parts disposed therebetween, and portions of the first, second, and third central conductors intersect vertically. The first, second, and third central conductors and the first dielectric parts are formed of multilayer thin films or thick films. Each of the first, second, and third central conductors includes a first extended portion which extends from one end of the corresponding central conductor and which is disposed on a side surface of the ferrite part and a second extended portion which extends from the other end of the corresponding central conductor and which is disposed on the side surface of the ferrite portion. The adjacent first and second extended portions facing each other with a second dielectric part, which is formed of a thin film or a thick film, disposed therebetween form a capacitor. With this arrangement, without using known chip capacitors, the capacitors are thinly formed, leading to reduction in size and cost of the non-reciprocal circuit element. Since the capacitors are formed between the central conductors, wiring, such as wire-bonding, becomes unnecessary. The non-reciprocal circuit element thus becomes easy to assemble.

Each of the first and second extended portions may include a longitudinal extended segment extending downward from one end of the corresponding central conductor and a lateral extended segment extending orthogonally to the longitudinal extended segment. The lateral extended segments of the adjacent first and second extended portions may face each other with the second dielectric part disposed therebetween to form the capacitor. Accordingly, the side surface of the ferrite part is used effectively. The easy-adjustable capacitors with large capacitances and good capacitance accuracy are achieved.

A first capacitor may be formed between the first and third central conductors, a second capacitor may be formed between the first and second central conductors, and a third capacitor may be formed between the second and third central conductors. Accordingly, the small non-reciprocal circuit element, which is suitably applied to a circulator, is achieved.

A resistor formed of a thin film or a thick film may be disposed on the side surface of the ferrite part, and the resistor may be connected between the second extended portion of the first central conductor and the first extended portion of the third central conductor. Accordingly, without using a known chip resistor, the resistor is thinly formed. The small non-reciprocal circuit element, which is suitably applied to an isolator, is achieved.

The first and second extended portions may include first and second terminal portions, respectively, which are disposed on a bottom surface of the ferrite part, each first terminal portion extending from one end of the corresponding first extended portion, and each second terminal portion extending from one end of the corresponding second extended portion. Accordingly, the central conductors are easily connected to other parts, such as a circuit board or an insulated board. The non-reciprocal circuit element thus becomes easy to assemble.

The second terminal portions may be connected to one another by a connecting conductor disposed on the bottom surface of the ferrite part. Accordingly, the second terminal portions to be grounded are reliably connected at the same time.

The non-reciprocal circuit element may further include first and second yokes connected to each other to form a magnetic closed circuit; a magnet disposed on the ferrite part; and a circuit board having first and second conductive patterns and holes. The bottom surface of the ferrite part may be placed on the circuit board. The first terminal portions may be connected respectively to the first conductive patterns, and the second terminal portions may be connected to the second conductive pattern. The first yoke may be disposed on the top surface of the ferrite part, and the second yoke may be disposed on a bottom surface of the circuit board. One or both of the first and second yokes may be disposed inside the holes, thereby connecting the first and second yokes with each other. With this arrangement, the non-reciprocal circuit element is directly embedded in the circuit board. The non-reciprocal circuit element thus becomes compact and easy to assemble.

The non-reciprocal circuit element may further include first and second yokes connected to each other to form a magnetic closed circuit; a magnet disposed on the ferrite part; and an insulated board having first and second leader terminals. The bottom surface of the ferrite part may be placed on the insulated board. The first terminal portions may be connected respectively to the first leader terminals, and the second terminal portions may be connected to the second leader terminal. The first yoke may be disposed on the top surface of the ferrite part, and the second yoke may be disposed on a bottom surface of the insulated board, thereby connecting the first and second yokes with each other. With this arrangement, the small non-reciprocal circuit element alone is easily manufactured.

According to another aspect of the present invention, a non-reciprocal circuit element is provided including a flat plate-shaped ferrite part; and first, second, and third central conductors disposed over a plurality of surfaces of the ferrite part, wherein the first, second, and third central conductors on a top surface of the ferrite part are stacked on one another with first dielectric parts disposed therebetween, and portions of the first, second, and third central conductors intersect vertically. The first, second, and third central conductors and the first dielectric parts are formed of multilayer thin films or thick films. Each of the first, second, and third central conductors includes a first extended portion which extends from one end of the corresponding central conductor and which is disposed on a side surface of the ferrite part; a second extended portion which extends from the other end of the corresponding central conductor and which is disposed on the side surface of the ferrite portion; a first terminal portion which extends from one end of the corresponding first extended portion and which is disposed on a bottom surface of the ferrite part; and a second terminal portion which extends from one end of the corresponding second extended portion and which is disposed on the bottom surface of the ferrite part. Accordingly, the central conductors are easily connected to other parts, such as a circuit board or an insulated board. The non-reciprocal circuit element thus becomes easy to assemble.

The second terminal portions may be connected to one another by a connecting conductor disposed on the bottom surface of the ferrite part. Accordingly, the second terminal portions to be grounded are reliably connected at the same time.

DESCRIPTION OF THE PREFERRED EMBODIMENTS

Figure 1:
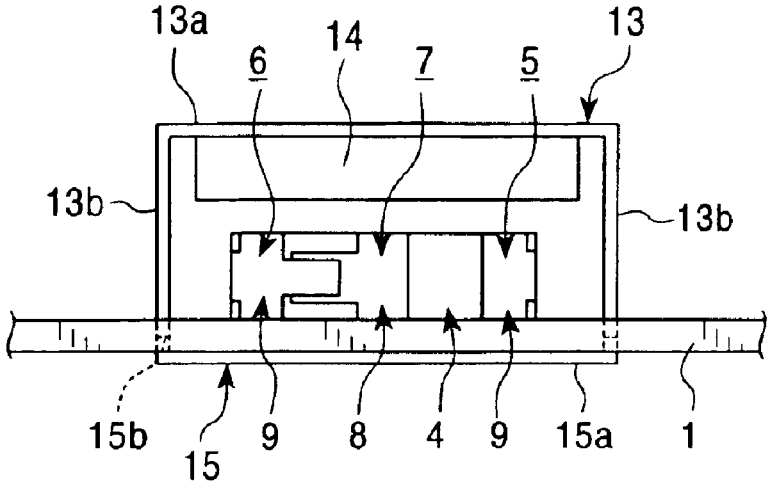
FIG. 1 is an elevation view of a non-reciprocal circuit element, which is applied to a circulator, according to a first embodiment of the present invention.
Figure 2:
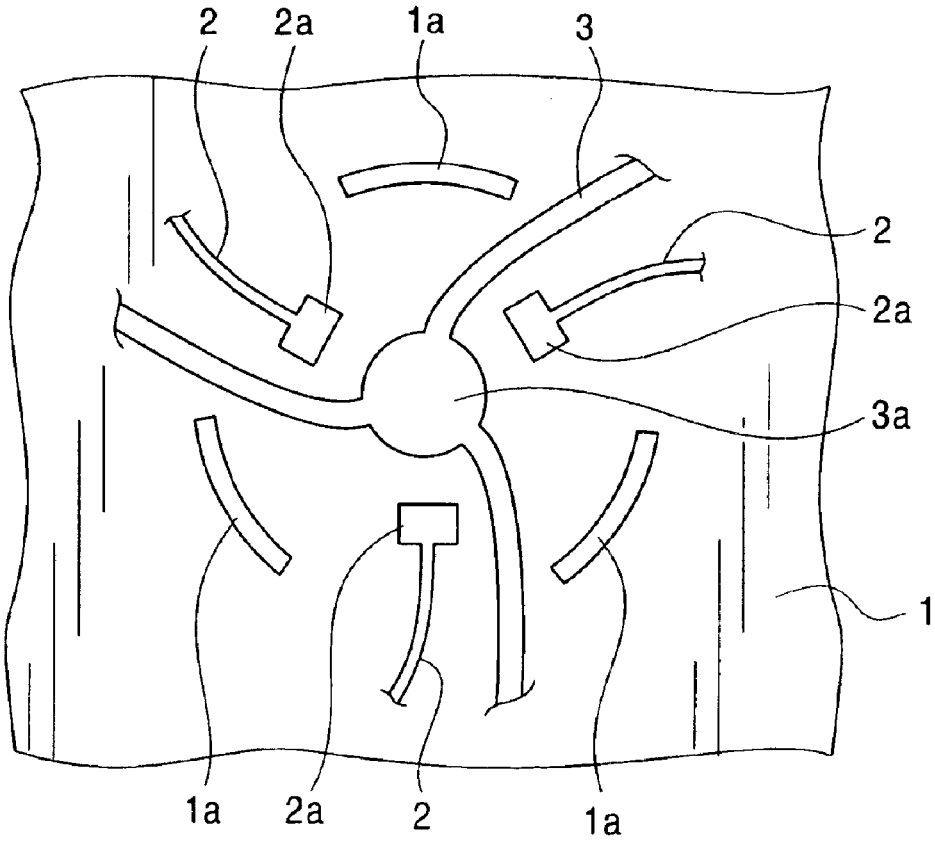
FIG. 2 is a plan view of a circuit board of the circulator shown in FIG. 1.
Figure 3:
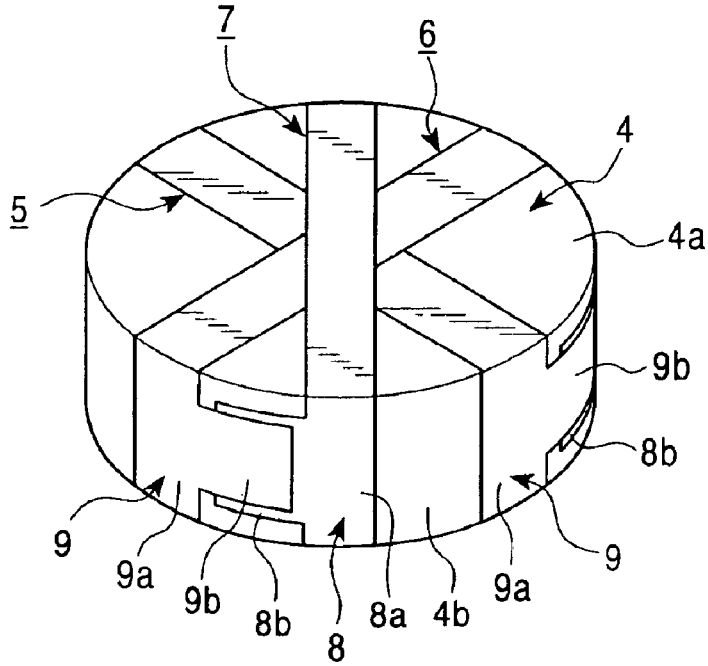
FIG. 3 is a perspective view of a ferrite part of the circulator shown in FIG. 1.
Figure 4:
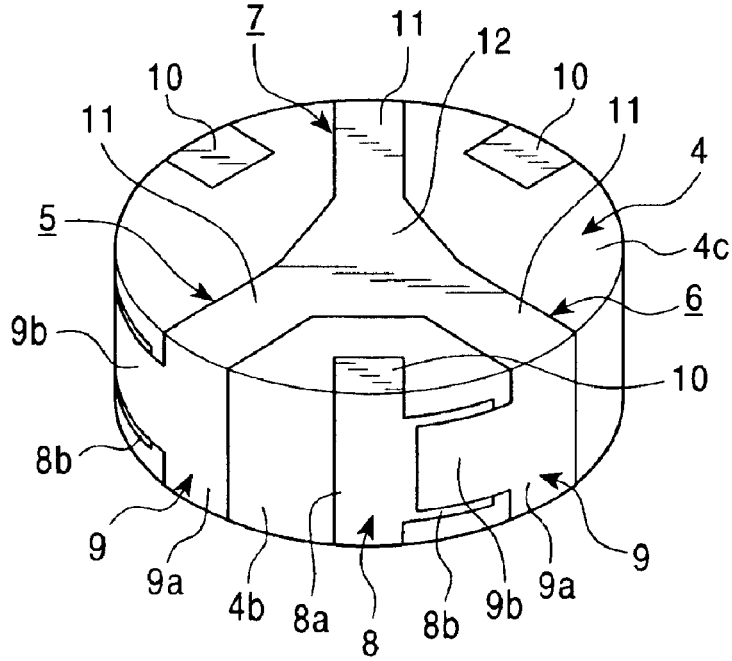
FIG. 4 is a perspective view of the ferrite part of the circulator shown in FIG. 1, which is viewed from the backside.
Figure 5:
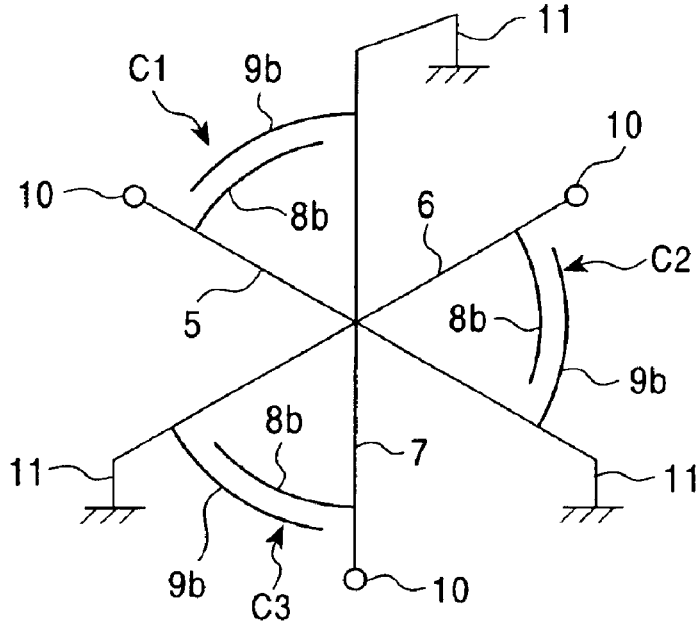
FIG. 5 is a three-dimensional wiring diagram of the circulator shown in FIG. 1.
Figure 6:
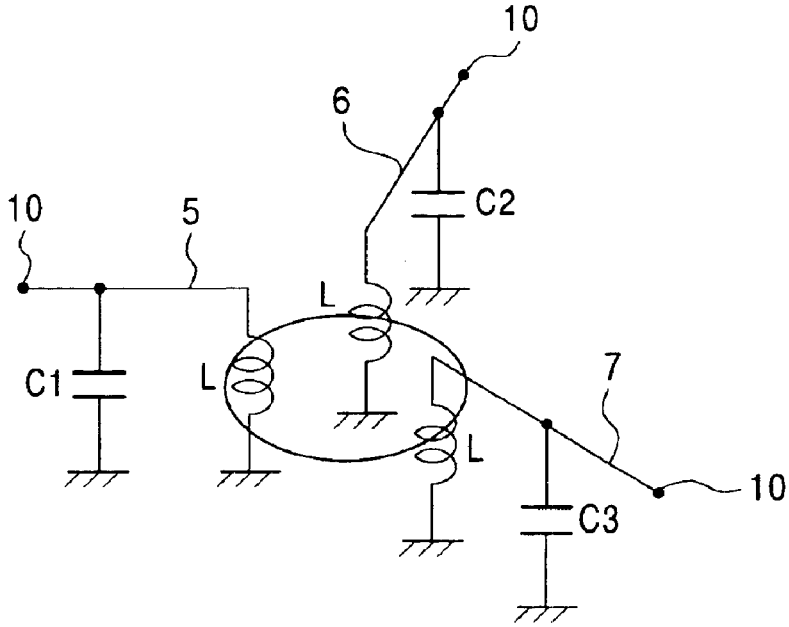
FIG. 6 is a circuit diagram of the circulator shown in FIG. 1.

The drawings of a non-reciprocal circuit element according to the present invention will now be described. FIG. 1 is an elevation view of a non-reciprocal circuit element, which is applied to a circulator, according to a first embodiment of the present invention. FIG. 2 is a plan view of a circuit board of the circulator shown in FIG. 1. FIG. 3 is a perspective view of a ferrite part of the circulator shown in FIG. 1. FIG. 4 is a perspective view of the ferrite part of the circulator shown in FIG. 1, which is viewed from the backside. FIG. 5 is a three-dimensional wiring diagram of the circulator shown in FIG. 1. FIG. 6 is a circuit diagram of the circulator shown in FIG. 1.

Figure 7:
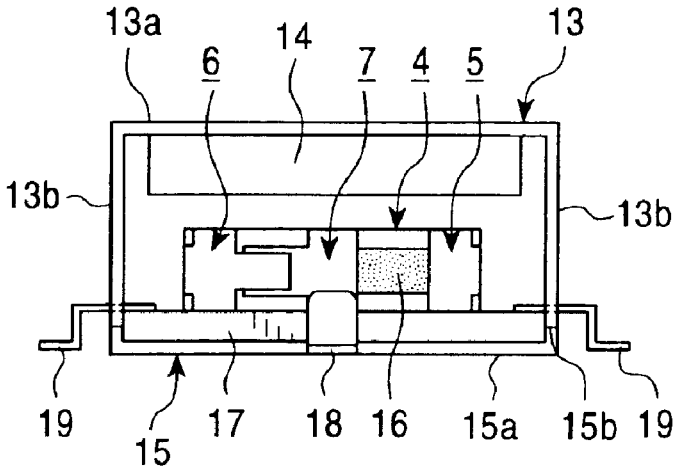
FIG. 7 is an elevation view of a non-reciprocal circuit element, which is applied to an isolator, according to a second embodiment of the present invention.
Figure 8:
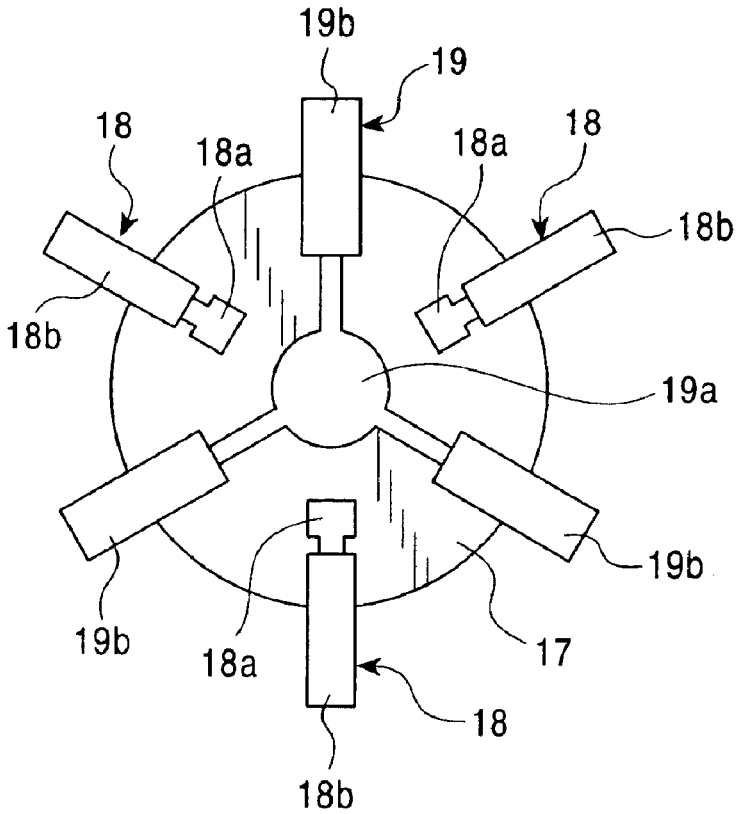
FIG. 8 is a plan view of an insulated board of the isolator shown in FIG. 7.
Figure 9:
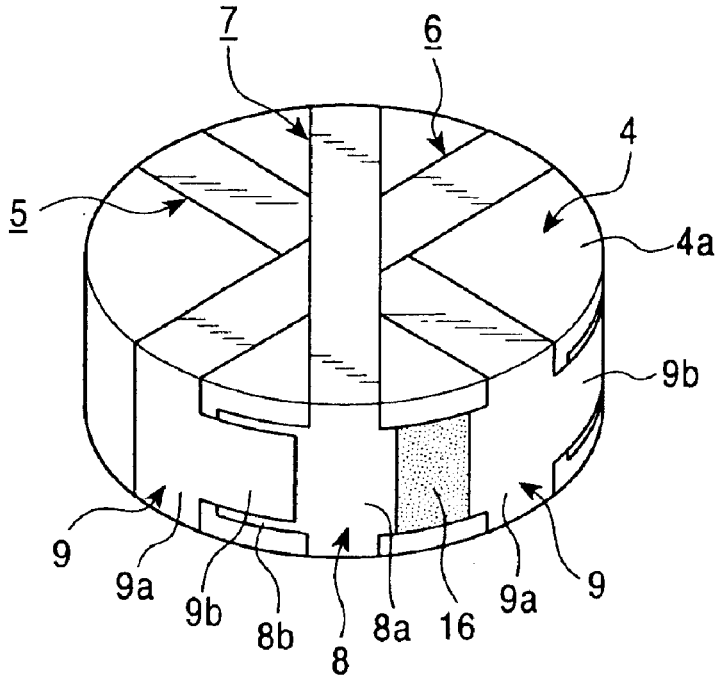
FIG. 9 is a perspective view of a ferrite part of the isolator shown in FIG. 7.
Figure 10:
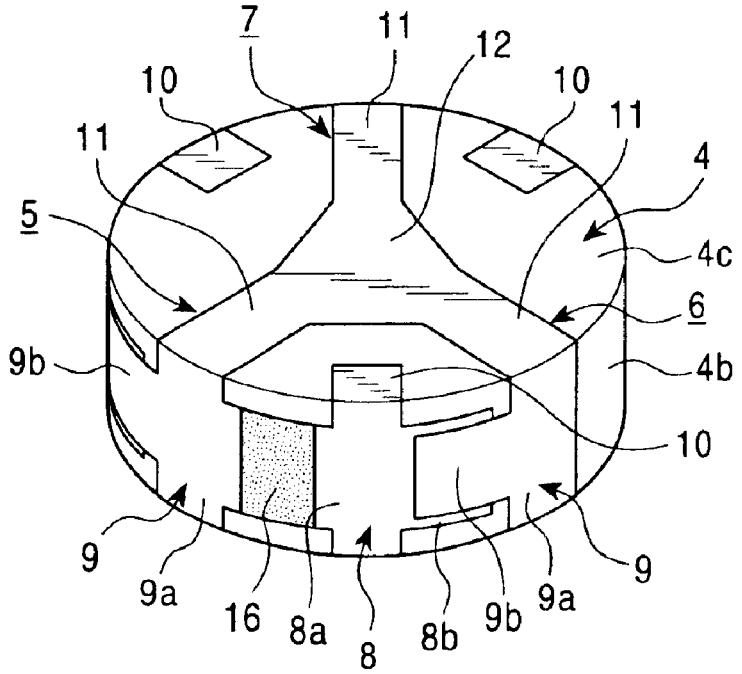
FIG. 10 is a perspective view of the ferrite part of the isolator shown in FIG. 7, which is viewed from the backside.
Figure 11:
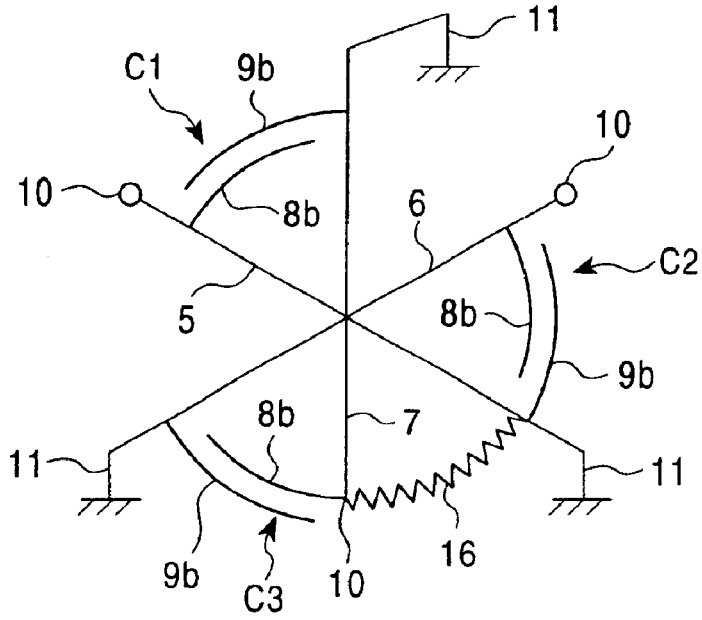
FIG. 11 is a three-dimensional wiring diagram of the isolator shown in FIG. 7.
Figure 12:
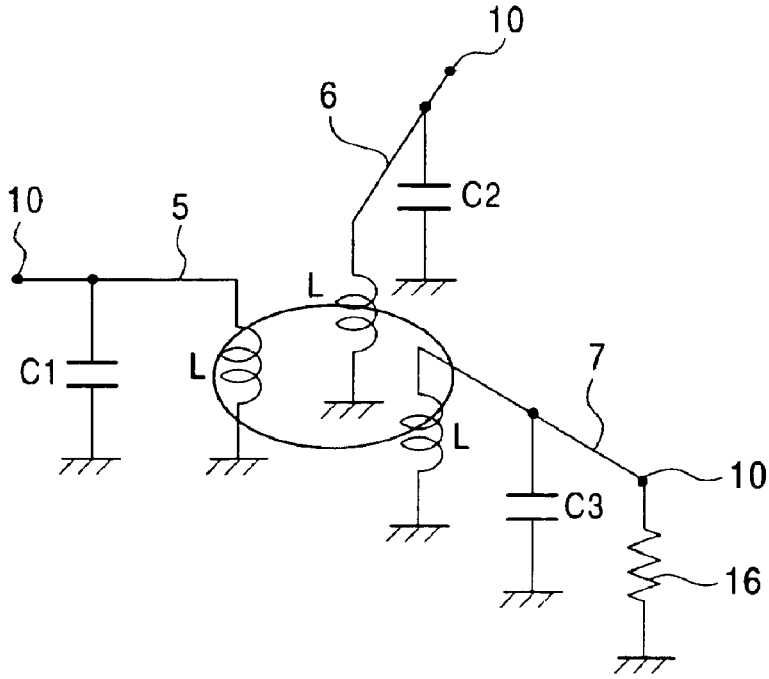
FIG. 12 is a circuit diagram of the isolator shown in FIG. 7.
Figure 13:
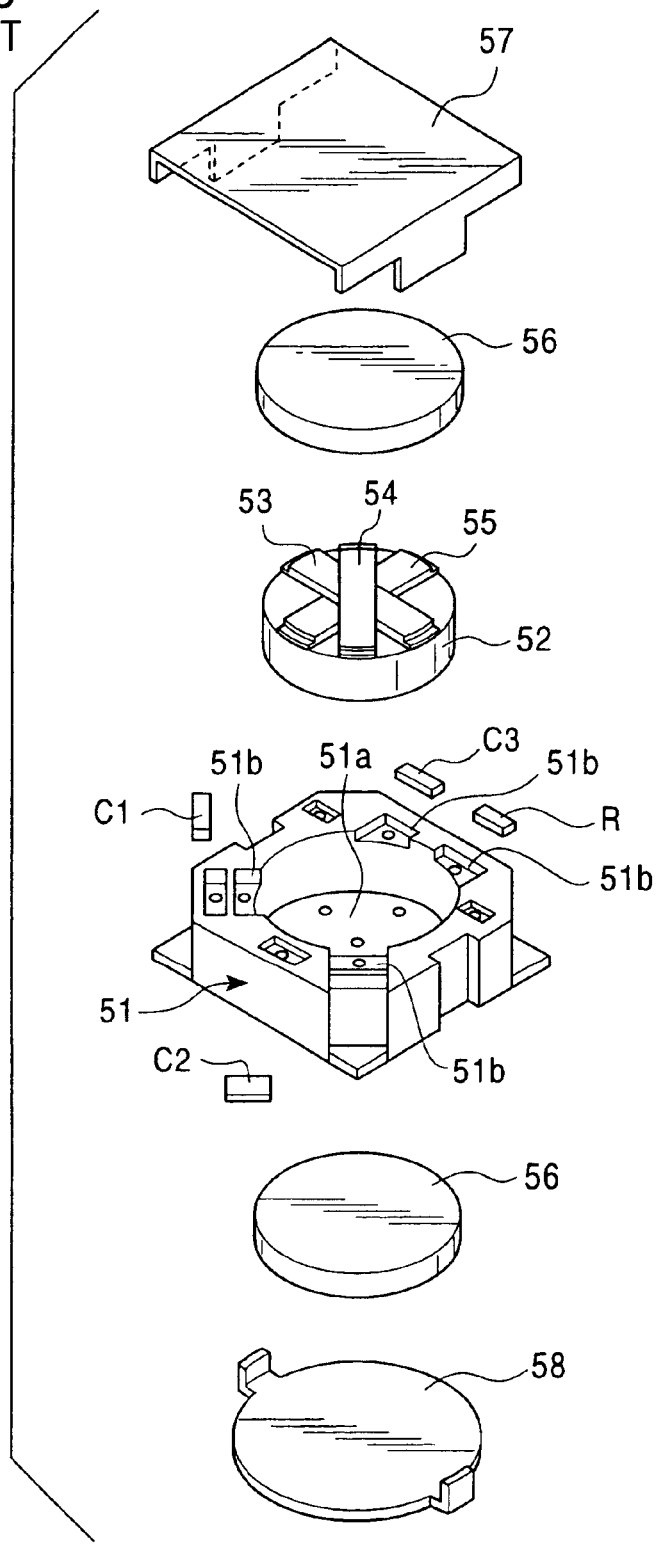
FIG. 13 PRIOR ART
FIG. 13 is an exploded perspective view of a known non-reciprocal circuit element.
Figure 14:
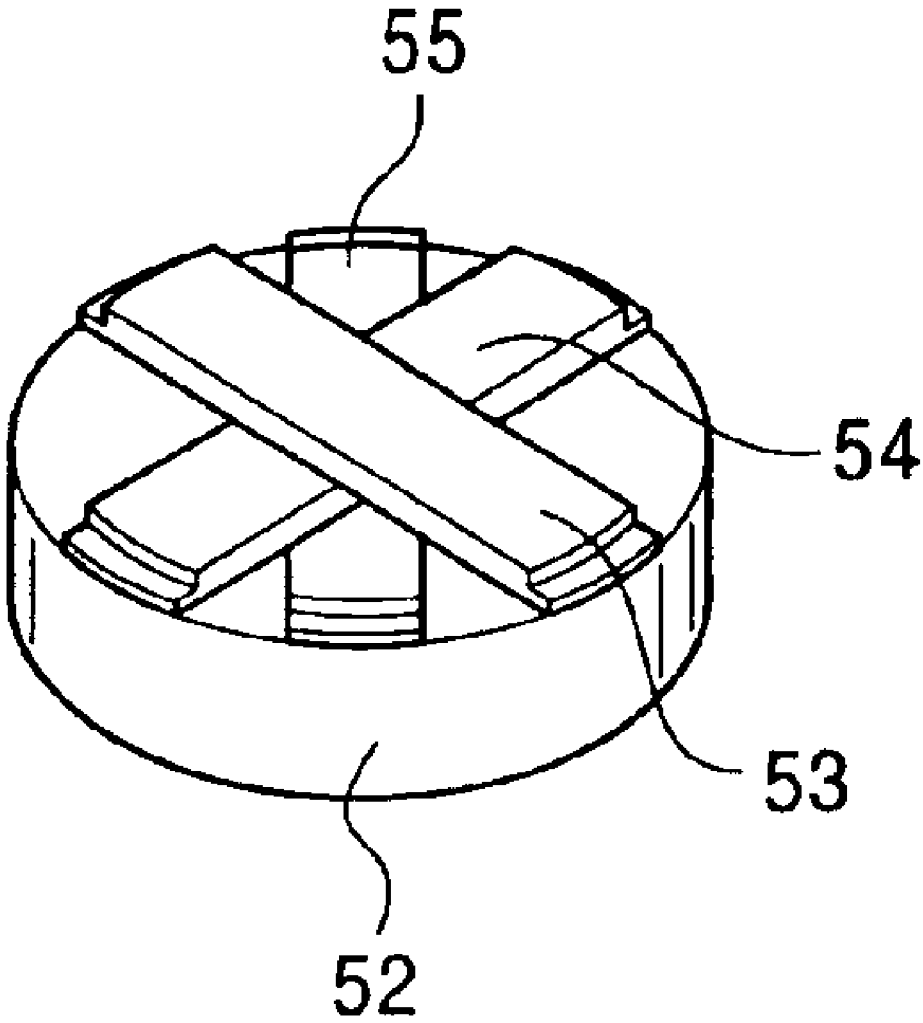
FIG. 14 PRIOR ART
FIG. 14 is a perspective view of a ferrite part of the known non-reciprocal circuit element shown in FIG. 13.

FIG. 7 is an elevation view of a non-reciprocal circuit element, which is applied to an isolator, according to a second embodiment of the present invention. FIG. 8 is a plan view of an insulated board of the isolator shown in FIG. 7. FIG. 9 is a perspective view of a ferrite part of the isolator shown in FIG. 7. FIG. 10 is a perspective view of the ferrite part of the isolator shown in FIG. 7, which is viewed from the backside. FIG. 11 is a three-dimensional wiring diagram of the isolator shown in FIG. 7. FIG. 12 is a circuit diagram of the isolator shown in FIG. 7.

Referring to FIGS. 1 to 6, the structure of the non-reciprocal circuit element, which is the circulator, according to the first embodiment of the present invention will now be described. With particular reference to FIG. 2, a circuit board 1, which is a printed circuit board, includes a plurality of arc-shaped holes 1*a*. On the top surface of the circuit board 1, a plurality of first conductive patterns 2 with land portions 2*a* are disposed at equal distances around a second conductive pattern 3 with a land portion 3*a*.

The first and second conductive patterns 2 and 3 are connected to a transmitting and receiving circuit disposed on the circuit board 1. The second conductive pattern 3 is used for grounding.

The land portions 2*a* and 3*a* are housed in the holes 1*a*.

On a ferrite part 4, which is a YIG (Yttrium iron garnet) flat plate (which is disc-shaped), first, second, and third central conductors 5, 6, and 7, which are formed of thin films or thick films, are disposed over a top surface 4*a*, a side surface 4*b*, and a bottom surface 4*c*.

The first, second, and third central conductors 5, 6, and 7 disposed on the top surface 4*a* of the ferrite part 4 are stacked on one another via first dielectric parts (not shown), which are formed of insulating thin films or insulating thick films, disposed therebetween. The first, second, and third central conductors 5, 6, and 7 are disposed at equal distances at an angle of 120°. Portions of the first, second, and third central conductors 5, 6, and 7 intersect vertically.

To form the first, second, and third central conductors 5, 6, and 7 using thin films, chromium (Cr), copper (Cu), and the like are deposited by evaporation. To form the first, second, and third central conductors 5, 6, and 7 using thick films, a silver (Ag) paste and a copper (Cu) paste are printed.

To form the first insulating parts (not shown) for insulating between the first, second, and third central conductors 5, 6, and 7 using thin films, silicon oxide and the like are deposited by evaporation. To form the first insulating parts using thick films, palladium titanate and the like are printed.

Each of the first, second, and third central conductors 5, 6, and 7 includes a first extended portion 8 which extends from one end of the corresponding central conductor and which is disposed on the side surface 4*b* of the ferrite part 4 and a second extended portion 9 which extends from the other end of the corresponding central conductor and which is disposed on the side surface 4*b* of the ferrite part 4.

Each first extended portion 8 includes a longitudinal extended segment 8*a* extending downward from the top surface and a lateral extended segment 8*b* extending orthogonally to the longitudinal extended segment 8*a*. The second extended portion 9 includes a longitudinal extended segment 9*a* extending downward from the top surface and a lateral extended segment 9*b* extending orthogonally to the longitudinal extended segment 9*a*.

The first and second extended portions 8 and 9 of the first, second, and third central conductors 5, 6, and 7 include first and second terminal portions 10 and 11, respectively. Each first terminal portion 10 extends from one end of the corresponding first extended portion 8 and is disposed on the bottom surface 4*c* of the ferrite part 4, and each second terminal portions 11 extends from one end of the corresponding second extended portion 9 and is disposed on the bottom surface 4*c* of the ferrite part 4. The second terminal portions 11 are connected with one another by a connecting conductor 12 disposed on the bottom surface 4*c* of the ferrite part 4.

The lateral extended segment 8*b* of the first extended portion 8 of the first central conductor 5 faces the lateral extended segment 9*b* of the second extended portion 9 of the third central conductor 7 with a second dielectric part (not shown) formed of an insulating thin film or an insulating thick film disposed therebetween, thereby forming a first capacitor C1 between the adjacent first and second extended portions 8 and 9.

The lateral extended segment 9*b* of the second extended portion 9 of the first central conductor 5 faces the lateral extended segment 8*b* of the first extended portion 8 of the second central conductor 6 with a second dielectric part (not shown) formed of an insulating thin film or an insulating thick film disposed therebetween, thereby forming a second capacitor C2 between the adjacent first and second extended portions 8 and 9.

The lateral extended segment 9*b* of the second extended portion 9 of the second central conductor 6 faces the lateral extended segment 8*b* of the first extended portion 8 of the third central conductor 7 with a second dielectric part (not shown) formed of an insulating thin film or an insulating thick film disposed therebetween, thereby forming a third capacitor C3 between the adjacent first and second extended portions 8 and 9.

As a result, the first, second, and third capacitors C1, C2, and C3 are wired, as shown in FIG. 5.

To form the second dielectric parts insulating between the first and second extended portions 8 and 9 using thin films, as in the first dielectric parts, silicon oxide and the like are deposited by evaporation. To form the second dielectric parts using thick films, palladium titanate and the like are printed.

The capacitance of each capacitor can be adjusted by trimming the upper one of the corresponding lateral extended segments.

The bottom surface 4*c* of the ferrite part 4 arranged as described above is placed on the circuit board 1. Each of the first terminal portions 10 is connected by soldering to the land portion 2*a* of the corresponding first conductive pattern 2. The connecting conductor 12, which is electrically connected to the second terminal portions 11, is connected by soldering to the land portion 3*a* of the second conductive pattern 3. As a result, the second terminal portions 11 are grounded.

A first yoke 13, which is a magnetic plate (steel plate or the like), is U-shaped and includes a top plate 13*a* and side plates 13*b* extending downward from two facing sides of the top plate 13*a*. On the inner side of the top plate 13*a*, a magnetic bar 14 is disposed.

The magnetic bar 14 is disposed above the ferrite part 4. Lower end portions of the side plates 13*b* are disposed inside the holes 1*a*.

A second yoke 15, which is a U-shaped magnetic plate (steel plate or the like), includes a quadrilateral bottom plate 15*a* and a pair of side plates 15*b* extending upward from two facing sides of the bottom plate 15*a*.

While the second yoke 15 is disposed on the bottom surface of circuit board 1, upper end portions of the side plates 15*b* are disposed inside the holes 1*a*. Therefore, the first and second yokes 13 and 15 are connected to each other.

As a result, the first and second yokes 13 and 15 form a magnetic closed circuit.

Referring to FIGS. 4 and 6, the first terminal portions 10 of the first, second, and third central conductors 5, 6, and 7 are grounded via the first, second, and third capacitors C1, C2, and C3. The second terminal portions 11 are grounded.

Although the capacitors are provided in the first embodiment, the capacitors may not be provided.

Although the first and second yokes 13 and 15 are disposed inside the holes 1*a*, only one of the first and second yokes 13 and 15 may be disposed inside the holes 1*a*.

FIGS. 7 to 12 show a case in which a non-reciprocal circuit element according to a second embodiment of the present invention is applied to an isolator. A first difference between the first and second embodiments is that a resistor 16 is additionally disposed, as particularly shown in FIGS. 9 and 10.

The resistor 16, which is formed of a thin film or a thick film, is disposed on the side surface 4*b* of the ferrite part 4. To form the resistor 16 using a thin film, tantalum and silicon oxide are deposited by evaporation. To form the resistor 16 using a thick film, a resistive material consisting of a mixture of carbon and an organic binder or the like is printed.

The resistor 16 is connected to the second extended portion 9 of the first central conductor 5 and to the first extended portion 8 of the third central conductor 7.

A second difference between the first and second embodiments is that, instead of using the circuit substrate 1, an insulated board 17 is used in the second embodiment. With particular reference to FIG. 8, the insulated board 17 includes first leader terminals 18 disposed at equal distances at an angle of 120° and a second leader terminal 19 arranged between the first leader terminals 18.

Each of the first leader terminals 18 consists of a land portion 18*a* formed of a conductive pattern and a terminal strip 18*b* which is electrically connected to the land portion 18*a* and which is mounted on the insulated board 17. The second leader terminal 19 consists of a land portion 19*a* formed of a conductive pattern and terminal strips 19*b* which are electrically connected to the land portion 19*a* and which are mounted on the insulated board 17.

The bottom surface 4*c* of the ferrite part 4 is placed on the insulated board 17. The first terminal portions 10 are respectively connected by soldering to the land portions 18*a* of the first leader terminals 18. The connecting conductor 12, which is electrically connected to the second terminal portions 11, is connected by soldering to the land portion 19*a* of the second leader terminal 19, and hence the second terminal portions 11 are grounded.

Alternatively, the first and second leader terminals 18 and 19 may be formed by embedding terminals formed of metal plates in the insulated board 17, so that these terminals may serve both as the land portions 18*a* and 19*a* and the terminal strips 18*b* and 19*b*.

Since the other structure of the second embodiment is the same as that of the first embodiment, the same reference numeral is given to the same part, and a repeated description thereof is omitted.

Referring to FIGS. 11 and 12 showing the isolator arranged as described above according to the second embodiment, the first terminal portions 10 of the first and second central conductors 5 and 6 are grounded via the first and second capacitors C1 and C2; the second terminal portions 11 of the first and second central conductors 5 and 6 are grounded; the first terminal portion 10 of the third central conductor 7 is grounded via the third capacitor C3 and the resistor R; and the second terminal portion 11 of the third central conductor 7 is grounded.

Although the capacitors and the resistors are disposed in the second embodiment, the capacitors and the resistors may not be disposed.

The circuit board 1 of the first embodiment may be replaced by the insulated board 17 of the second embodiment. The insulated board 17 of the second embodiment may be replaced by the circuit board 1 of the first embodiment.

What is claimed is:

1. A non-reciprocal circuit element comprising:

a flat plate-shaped ferrite part; and first, second, and third central conductors disposed over a plurality of surfaces of the ferrite part, wherein the first, second, and third central conductors on a top surface of the ferrite part are stacked on one another with first dielectric parts disposed therebetween, and portions of the first, second, and third central conductors intersect vertically, wherein the first, second, and third central conductors and the first dielectric parts are formed of multilayer thin films or thick films, wherein each of the first, second, and third central conductors includes a first extended portion which extends from one end of the corresponding central conductor and which is disposed on a side surface of the ferrite part and a second extended portion which extends from another end of the corresponding central conductor and which is disposed on the side surface of the ferrite portion, and wherein adjacent first and second extended portions facing each other with a second dielectric part, which is formed of a thin film or a thick film, disposed therebetween form a capacitor.

2. A non-reciprocal circuit element according to claim 1, wherein each of the first and second extended portions includes a longitudinal extended segment extending downward from one end of the corresponding central conductor and a lateral extended segment extending orthogonally to the longitudinal extended segment, and wherein the lateral extended segments of the adjacent first and second extended portions face each other with the second dielectric part disposed therebetween to form the capacitor.

3. A non-reciprocal circuit element according to claim 1, wherein a first capacitor is formed between the first and third central conductors, a second capacitor is formed between the first and second central conductors, and a third capacitor is formed between the second and third central conductors.

4. A non-reciprocal circuit element according to claim 1, wherein a resistor formed of a thin film or a thick film is disposed on the side surface of the ferrite part, and the resistor is connected between the second extended portion of the first central conductor and the first extended portion of the third central conductor.

5. A non-reciprocal circuit element according to claim 1, wherein the first and second extended portions include first and second terminal portions, respectively, which are disposed on a bottom surface of the ferrite part, each first terminal portion extending from one end of the corresponding first extended portion, and each second terminal portion extending from one end of the corresponding second extended portion.

6. A non-reciprocal circuit element according to claim 5, wherein the second terminal portions are connected to one another by a connecting conductor disposed on the bottom surface of the ferrite part.

7. A non-reciprocal circuit element according to claim 5, further comprising:

first and second yokes connected to each other to form a magnetic closed circuit a magnet disposed on the ferrite part; and a circuit board having first and second conductive patterns and holes, wherein the bottom surface of the ferrite part is placed on the circuit board, wherein the first terminal portions are respectively connected to the first conductive patterns, and the second terminal portions are connected to the second conductive pattern, wherein the first yoke is disposed on the top surface of the ferrite part, and the second yoke is disposed on a bottom surface of the circuit board, and wherein at least one of the first and second yokels are disposed inside the holes, thereby connecting the first and second yokes with each other.

8. A non-reciprocal circuit element according to claim 5, further comprising:

first and second yokes connected to each other to form a magnetic closed circuit;

a magnet disposed on the ferrite part; and an insulated board having first and second leader terminals, wherein the bottom surface of the ferrite part is placed on the insulated board, wherein the first terminal portions are respectively connected to the first leader terminals and the second terminal portions are connected to the second leader terminal, and wherein the first yoke is disposed on the top surface of the ferrite part, and the second yoke is disposed on a bottom surface of the insulated board, thereby connecting the first and second yokes with each other.

9. A non-reciprocal circuit element comprising:

a flat plate-shaped ferrite part; and first, second, and third central conductors disposed over a plurality of surfaces of the ferrite part, wherein the first, second, and third central conductors on a top surface of the ferrite part are stacked on one another with first dielectric parts disposed therebetween, and portions of the first, second, and third central conductors intersect vertically, wherein the first, second, and third central conductors and the first dielectric parts are formed of multilayer thin films or thick films, and wherein each of the first, second, and third central conductors includes a first extended portion which extends from one end of the corresponding central conductor and which is disposed on a side surface of the ferrite part; a second extended portion which extends from another end of the corresponding central conductor and which is disposed on the side surface of the ferrite portion; a first terminal portion which extends from one end of the corresponding first extended portion and which is disposed on a bottom surface of the ferrite part; and a second terminal portion which extends from one end of the corresponding second extended portion and which is disposed a the bottom surface of the ferrite part.

10. A non-reciprocal circuit element according to claim 9, wherein the second terminal portions are connected to one another by a connecting conductor disposed on the bottom surface of the ferrite part.

* * * * *

UNITED STATES PATENT AND TRADEMARK OFFICE

CERTIFICATE OF CORRECTION

PATENT NO. : 6,943,641 B2
DATED : September 13, 2005
INVENTOR(S) : Yuichi Shimizu It is certified that error appears in the above-identified patent and that said Letters Patent is hereby corrected as shown below:

Column 8,
Line 17, after "first and second" delete "yokels" and substitute -- yokes --.

Column 9,
Line 11, after "first leader terminals" insert -- , -- (comma).

Signed and Sealed this

Thirteenth Day of June, 2006

JON W. DUDAS
*Director of the United States Patent and Trademark Office*